US005441348A

United States Patent [19]

Valentino

[11] Patent Number: 5,441,348

[45] Date of Patent: Aug. 15, 1995

[54] INSERT FOR DECORATIVE GIFT BAG AND METHOD OF USING

[76] Inventor: George Valentino, 2667 Rockaway Ave., Oceanside, N.Y. 11572

[21] Appl. No.: 274,484

[22] Filed: Jul. 13, 1994

[51] Int. Cl.[6] ..... B65D 30/20

[52] U.S. Cl. ..... 383/127; 383/111; 383/120; 229/87.03; 206/457

[58] Field of Search ..... 383/200, 207, 98, 99, 383/120, 111, 127, 71; 229/87.03,87.05, 87.18, 87.19, 922, 923; 206/457

[56] References Cited

U.S. PATENT DOCUMENTS

| | | | |
|---|---|---|---|
| 208,138 | 9/1878 | Arkell | 383/98 |
| 426,774 | 4/1890 | Claussen | 383/120 |
| 1,628,429 | 5/1927 | Radford | 229/87.05 X |
| 1,907,082 | 5/1933 | Meltzer | 383/120 X |
| 3,495,762 | 2/1970 | Verbic | 383/120 |
| 4,932,556 | 6/1990 | Hui et al. | 383/207 X |
| 5,265,727 | 11/1993 | Anderson | 206/457 |

FOREIGN PATENT DOCUMENTS

| | | | |
|---|---|---|---|
| 10985 | of 1907 | United Kingdom | 383/120 |
| 576968 | 4/1946 | United Kingdom | 383/98 |

*Primary Examiner*—Allan N. Shoap
*Assistant Examiner*—Jes F. Pascua
*Attorney, Agent, or Firm*—Gerard F. Dunne

[57] ABSTRACT

A decorative bag and method of using are provided which includes an insert to be positioned within the bottom portion of a decorative bag having an open top. The insert includes a plurality of lengths of paper fan-folded thereon and each length of paper has a length enabling it to be extended outwardly from the open top of the bag. At least the upper portion of each length of paper is cut longitudinally to enable the length to be extended outwardly from the bag and individually separated so that they may be able to form a decorative surface for an item placed within the bag.

8 Claims, 6 Drawing Sheets

INSERT FOR DECORATIVE GIFT BAG AND METHOD OF USING

FIELD OF THE INVENTION

The present invention relates to an insert which can be positioned within a decorative gift bag to provide a decorative wrapping of tissue paper or the like for a product to be inserted within the gift bag.

BACKGROUND OF THE INVENTION

Various types of decorative bags are provided by department stores, specialty shops and the like; and typically such gift bags have an open top and a decorative motif. Typically, after a purchase is made by a consumer, the purchase is wrapped in tissue paper and then inserted within the open top of the gift bag to provide a pleasing appearance. The tissue paper most often is to be purchased separately, or the store personnel must initially wrap the purchase in tissue paper prior to inserting within the gift bag. The use of separate tissue paper is thus time consuming and sometimes unwieldy for the sales personnel or the purchaser to wrap the purchased item decoratively for insertion in the gift bag. Proposals have been made to provide wrapping internally with a box; as disclosed for example in U.S. Pat. No. 4,571,232 to Diehl. This patent, however, discloses the use of a wrapping paper secured interiorly into a folded carton; and does not provide for any enhanced decorative effects other than the mere folding of the wrapping material over an item to be presented within a closed box.

It is, therefore, an object of the present invention to provide an insert for a decorative gift bag which can be used easily and will provide an enhanced pleasing effect for an item to be inserted within the gift bag.

SUMMARY OF THE INVENTION

According to the present invention, an insert for use with a decorative bag includes a flat platform adapted to be inserted within a decorative bag to provide a bottom support for the bag. This platform carries a plurality of lengths of paper, preferably tissue paper, folded thereon. Each of the lengths of paper is dimensioned to extend outwards from the open top of the bag, and has at least the upper portion thereof cut longitudinally to enable the length to be extended outwardly from the decorative bag and, thereafter, joined together to provide a decorative cover for an item that would be inserted within the bag. Preferably, the lengths of paper are fan-folded to provide segments lying atop one another on the platform; and tabs are provided on the uppermost of each segment of a respective length to enable the user to pull the lengths outwardly from the bottom of the bag towards the open top.

In this way, an item to be purchased and contained within a decorative bag can be easily and conveniently wrapped in a paper material such as tissue paper in a manner which will provide an enhanced appearance.

These and other objects, advantages and features of the present invention will become more apparent from the detailed descriptions made below in conjunction with the accompanying drawings.

DETAILED DESCRIPTION OF PREFERRED EMBODIMENT

Figure 1:
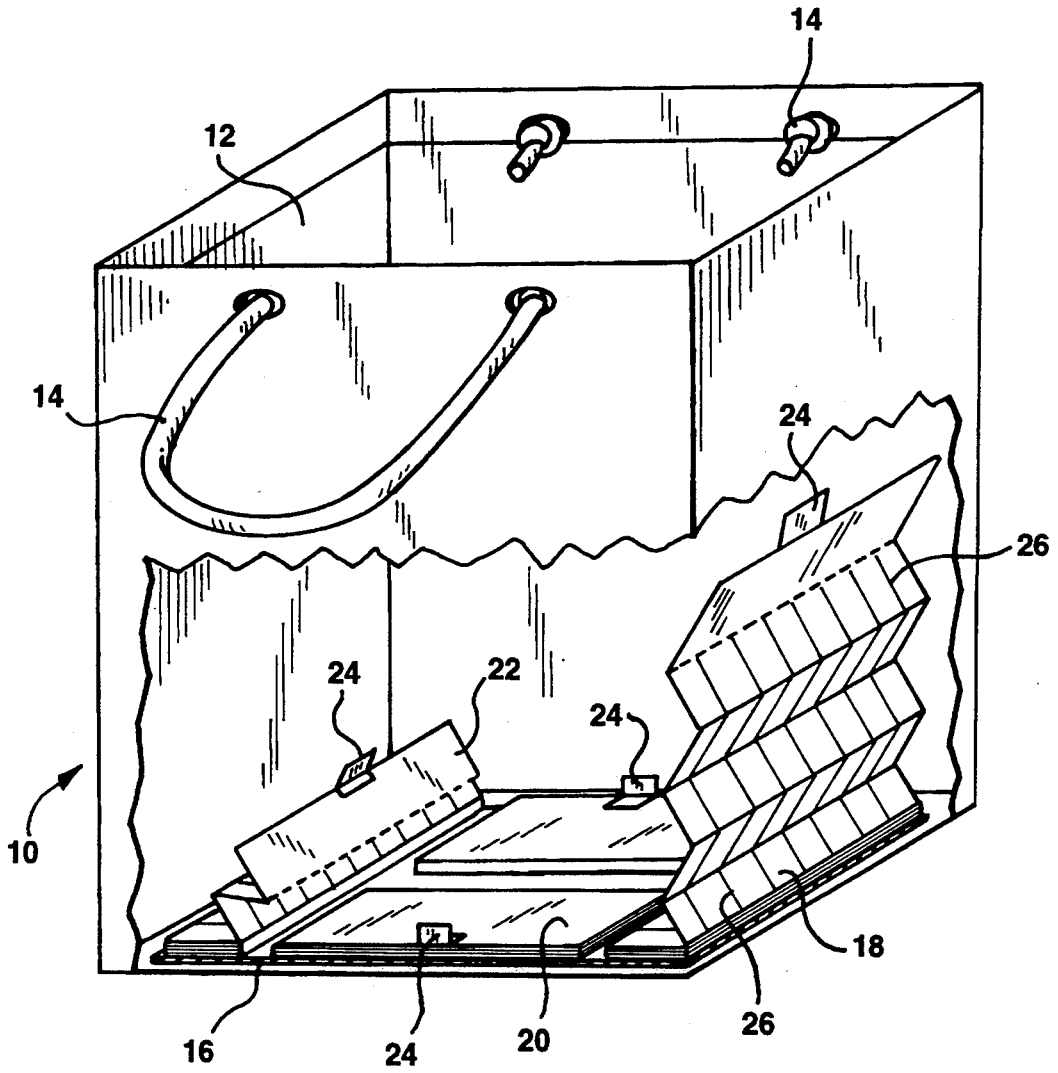
FIG. 1 illustrates a perspective view partially in section of a gift bag carrying the insert of the present invention.
Figure 2:
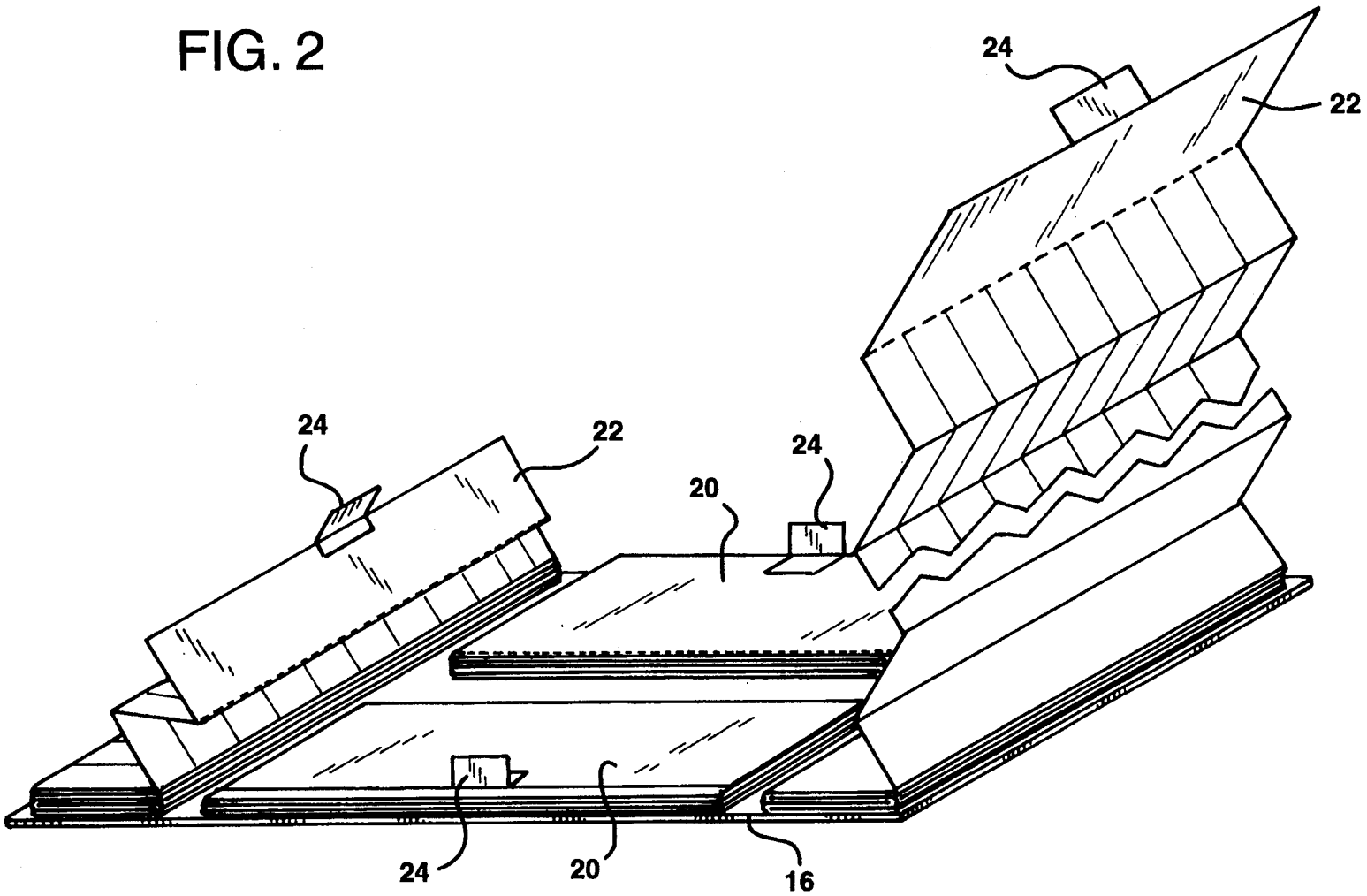
FIG. 2 illustrates the insert of FIG. 1.

As illustrated in FIG. 1, the gift bag 10 preferably includes a four-sided bag with an open top 12 which can be folded so as to be stored in a compressed and essentially flat condition. The gift bag of the illustrated embodiment of the present invention includes handles 14 as well-known in the art; and typically such gift bags 10 include a cardboard insert to be inserted in the bottom of the bag to add structural rigidity to the unfolded bag as well as a platform to support items to be placed in the bag.

As is well understood in the art, such gift bags are typically decorated fancifully or might include the logo or name of a prominent specialty store or the like; and such gift bags normally serve as the medium for presenting a purchased item as a gift to the recipient.

In the present invention, the insert includes a flat platform 16 which can be similar to the cardboard backing that is often inserted in the bottom of such gift bags. The flat platform 16 carries a plurality of lengths 18 of tissue paper which are fan-folded to provide individual segments lying atop one another. These individual segments in their fan-folded position provide, in the illustrated embodiment, for stacks 20 of fan-folded paper carried on platform 16. The lowermost segment of each stack is secured permanently to the platform 16. The uppermost segment 22 of each stack 20 has a pull tab 24 secured thereon so that each individual length of fan-folded paper may be pulled by a tab 24 upwardly as illustrated for one of the stacks in FIG. 1.

Preferably, the lengths of paper are formed of a decorative tissue-type paper; and may have imprinted thereon information to correspond to the decorative exterior of the bag 10. Alternately, the tissue paper may have imprinted thereon particular greetings such as "Happy Birthday", "Happy Father's Day" or the like. In this way, the tissue paper when used as described can form a decorative wrapping to enhance the packaging of a gift which might be purchased in a specialty store or the like.

Figure 3:
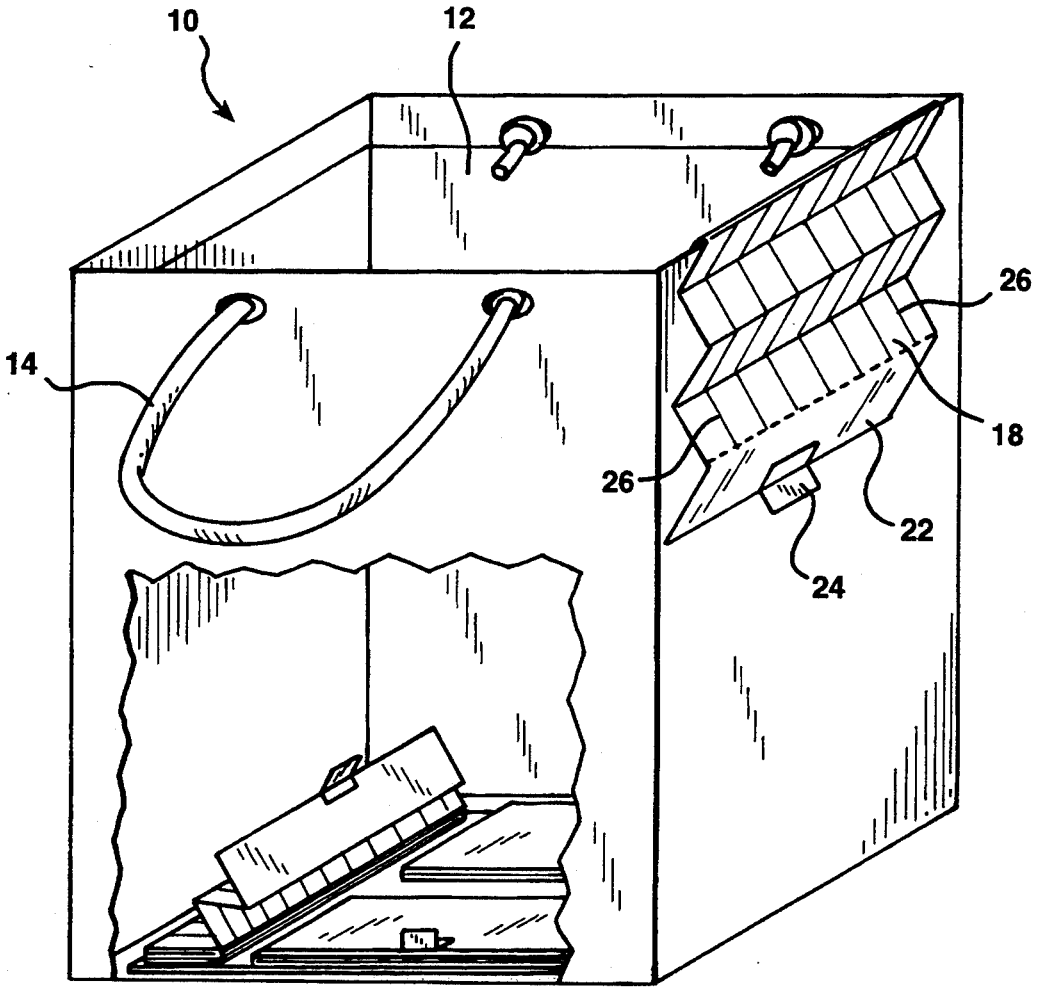
FIG. 3 illustrates an intermediate step in unfolding the insert of FIG. 2.

As illustrated in FIG. 3, the length 18 of the fan-folded paper may be pulled upwardly to the exterior of the open bag 10; and then caused to lie along the outside surface. Additionally, the upper portions of each length 18, except for the upmost segment 22, are each cut longitudinally as shown by the slits 26 to provide a plurality of separable strips which will be discussed more fully below. In a preferred form of the present invention, the slits 26 extend solely along the upper portion of each length 18, and preferably that portion of the length which could be extended outwardly from the open top 12 of the decorative bag 10. For example, the lengths 18 can be twice as long as the height of the gift bag 10, and thus the upper half of each length would then have the slits 26. The uppermost or leading segment 22 carrying the tab 24, however, would not have the slits 26 in order to retain the separable strips together when the lengths are pulled from the open top of the gift bag 10.

Figure 4:
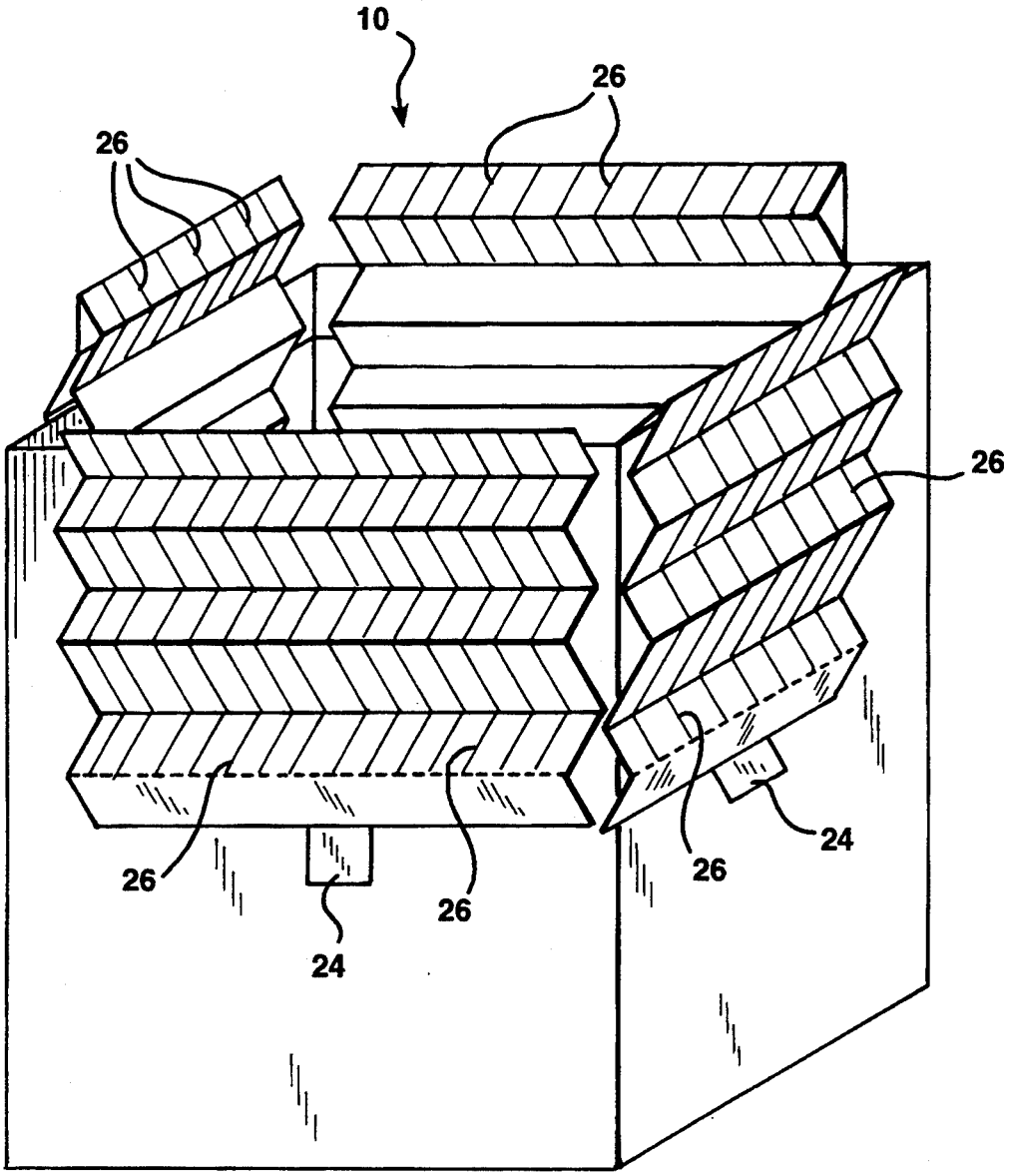
FIG. 4 illustrates the fully unfolded position of the insert of FIG. 2.
Figure 7:
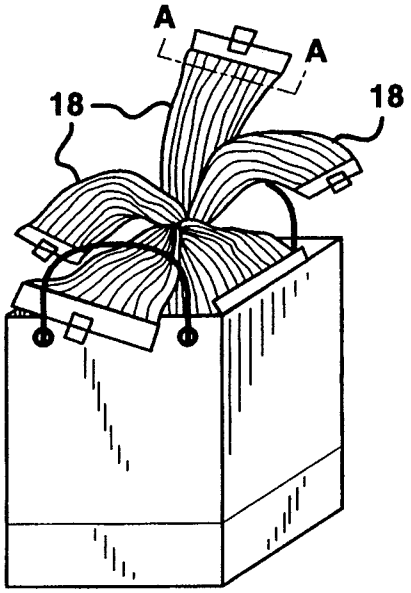
FIG. 7 illustrates the insert after being joined as illustrated in FIG. 6.
Figure 6:
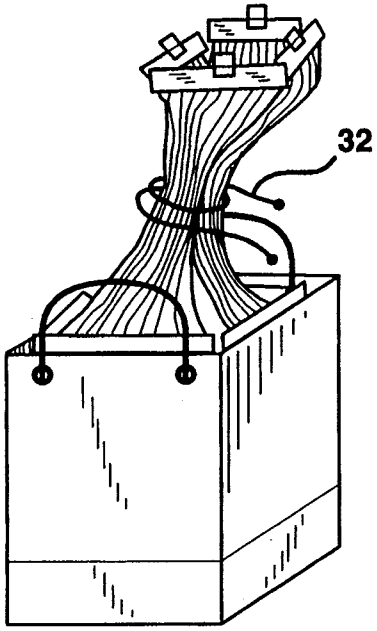
FIG. 6 illustrates the fully extended position of the insert.
Figure 5:
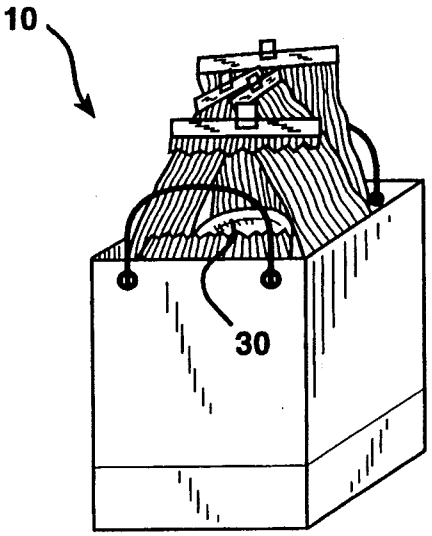
FIG. 5 illustrates an intermediate step in utilizing the insert of the present invention for wrapping an item within the gift bag of FIG. 1.
Figure 9:
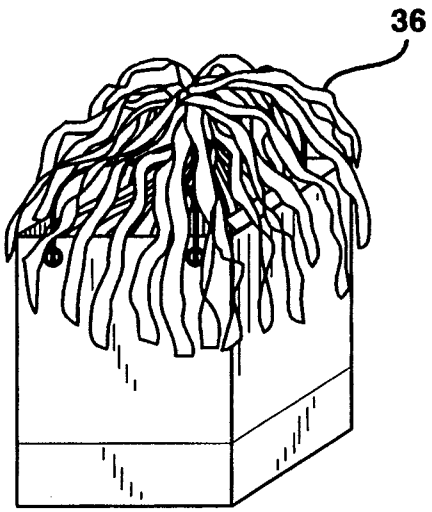
FIG. 9 illustrates another embodiment illustrating the finished use of the insert of the present invention within the decorative bag.
Figure 8:
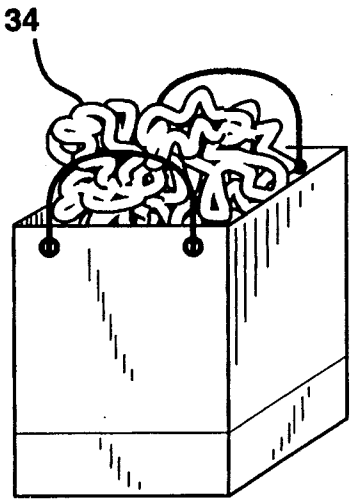
FIG. 8 illustrates one embodiments of the finished use of the insert of the present invention within the decorative bag.

As illustrated in FIG. 4, the upper portions of each stack 20 will eventually be extended and draped over the outer surface of the gift bag 10; and, thereafter, an item can be placed within the decorative bag 10 with the lengths 18 extending upwardly along the lateral sides of the item to be placed within the decorative bag. FIG. 5 illustrates an item 30 positioned within the decorative bag 10, and the four lengths 18 are all extended upwardly and have their mid portions joined as illustrated in FIG. 6 by a decorative ribbon 32 or the like. Thereafter, as illustrated in FIG. 7, the respective lengths 18 can be caused to drape outwardly to provide a decorative effect. Alternatively, each of the lengths can be cut in its upper portion through the slits 26 as illustrated by the line A—A in FIG. 7 to provide a plurality of streamers which can be bunched interiorly on the upper surface of item 30 in the bag to provide a bouquet effect as illustrated at 34 in FIG. 8, or caused to hang individually along the outer surfaces of the bag to form a cascading decorative effect as illustrated at 36 in FIG. 9.

Alternatively, the upper portion of each length 18 can be perforated or scored along line A—A to enable the uppermost segment 22 to be removed more easily.

As a result of use of the insert on the present invention, a store clerk or the like can place the insert in the bottom of the decorative gift bag and then easily arrange the folded lengths of tissue paper in a manner to provide a decorative and pleasing appearance. Time is saved in as much as the normal wrapping of a purchased gift with tissue paper and the like can be avoided; and a more decorative and pleasing effect can be arranged by use of the insert of the present invention.

The present invention has been described above in connection with a preferred embodiment; and the scope of the invention is not intended to be limited by any of the details described above, but by the appended claims.

What is claimed is:

1. An insert for a decorative bag having an open top, comprising a flat platform adapted to be inserted within a flexible decorative bag to produce a bottom support therefor, said platform carrying a plurality of lengths of paper folded thereon, said lengths of paper each having a length to extend outwards from the open top of said bag and having at least an upper portion thereof cut longitudinally to enable said lengths to be extended outwardly from said bag and thereafter joined together to provide a decorative cover for an item inserted within said bag.

2. An insert as set forth in claim 1, said lengths being fan-folded to provide segments adapted to lie on top of one another on said platform and respective tabs connected to the uppermost of each said segment for enabling the respective lengths to be pulled outwardly from the open top of said bag.

3. An insert as set forth in claim 1, said lengths having weakened portions transversely along said upper portions to enable said cut portions to be separated from one another.

4. A decorative bag including a bag element having an open top, and a flat platform adapted to be inserted within the bottom of said bag to provide a support therefor, said platform carrying a plurality of lengths of paper folded thereon, said lengths of paper each having a length to extend outwardly from the open top of said bag and having at least an upper portion thereof cut longitudinally to enable said lengths to be extended outwardly from said bag and thereafter joined together to provide a decorative cover for an item inserted within said bag.

5. A decorative bag as set forth in claim 4, said lengths being fan-folded to provide segments to lie on top of one another on said platform, and respected tabs connected to the uppermost of each segment for enabling the respective lengths to be pulled from the open top of said bag.

6. A decorative bag as set forth in claim 4, said lengths having weakened portions transversely along said upper portions to enable said cut portions to be separated from one another.

7. A method of providing a decorative packaging for an item, including providing a decorative bag having an open top, and inserting within the bottom portion of said bag a flat platform providing a bottom support for said bag, said platform carrying a plurality of lengths of paper folded thereon with said lengths of paper each having a length to extend outwardly from the open top of said bag, and each said length having at least an upper portion thereof cut longitudinally, extending said lengths outwardly from the open top of said bag, joining said lengths and then positioning said lengths to provide a decorative cover for an item inserted within said bag.

8. A method as set forth in claim 7, including separating said lengths at a top portion thereof to form decorative streamers.

* * * * *